US006899632B2

(12) United States Patent
Lane

(10) Patent No.: US 6,899,632 B2
(45) Date of Patent: May 31, 2005

(54) GOLF PUTTER

(75) Inventor: Daniel P. Lane, Bloomington, IL (US)

(73) Assignee: DL-45 Inc., Bloomington, IL (US)

( * ) Notice: Subject to any disclaimer, the term of this patent is extended or adjusted under 35 U.S.C. 154(b) by 0 days.

(21) Appl. No.: 10/260,812

(22) Filed: Sep. 30, 2002

(65) Prior Publication Data

US 2004/0063514 A1 Apr. 1, 2004

(51) Int. Cl.[7] ..... A63B 53/00

(52) U.S. Cl. ..... 473/215; 473/294; 473/297; 473/338; 473/341

(58) Field of Search ..... 473/340, 341, 473/338, 294, 298, 297, 299, 215, 216

(56) References Cited

U.S. PATENT DOCUMENTS

| | | | | | |
|---|---|---|---|---|---|
| 2,954,231 | A | * | 9/1960 | Macintyre | 473/251 |
| 3,679,207 | A | * | 7/1972 | Florian | 473/292 |
| D234,960 | S | * | 4/1975 | Swash | D21/739 |
| D234,962 | S | * | 4/1975 | Swash | D21/739 |
| 3,966,210 | A | * | 6/1976 | Rozmus | 473/341 |
| 4,461,479 | A | * | 7/1984 | Mitchell | 473/292 |
| 5,058,895 | A | * | 10/1991 | Igarashi | 473/341 |
| 5,209,474 | A | | 5/1993 | Voyer | |
| 5,377,987 | A | | 1/1995 | Irvin, Jr. | |
| 5,452,891 | A | * | 9/1995 | Thomas | 473/294 |
| 5,464,215 | A | * | 11/1995 | Koehler | 473/341 |
| 5,632,691 | A | * | 5/1997 | Hannon et al. | 473/292 |
| 5,643,109 | A | * | 7/1997 | Rose et al. | 473/329 |
| 5,779,559 | A | * | 7/1998 | Eberle | 473/294 |
| 5,976,025 | A | * | 11/1999 | Williams | 473/252 |
| 6,213,890 | B1 | * | 4/2001 | Prince | 473/292 |
| 6,371,864 | B1 | | 4/2002 | Norwood | |
| 6,394,910 | B1 | * | 5/2002 | McCarthy | 473/251 |

* cited by examiner

*Primary Examiner*—Stephen Blau
(74) *Attorney, Agent, or Firm*—Husch & Eppenberger, LLC; Robert C. Haldiman; David A. Chambers

(57) ABSTRACT

A golf putter and a method for using the same is disclosed. The golf putter includes a putter head with an insert and a radial bottom, a shaft attached to the putter head, and a grip having a gap and a weight attached to the shaft, wherein the gap includes a cutout for attaching a clip. When the clip is connected to a golfer's body, the golf putter is effectively anchored to the golfer. The method includes providing a golf club having a putter head with a putting face, approaching a golf ball such that the big toe of the foot furthest from the target is placed adjacent to the golf ball and the golfer's dominant eye is directly over the golf ball, positioning the golfer erect at forty-five degrees to the target, gripping the putter with the golfer's dominant arm, and putting the golf ball by moving the dominant arm and putter along the target line such that the face of the putter head engages the golf ball with appropriate force to drive the golf ball to the target.

14 Claims, 5 Drawing Sheets

GOLF PUTTER

BACKGROUND OF THE INVENTION

This invention relates generally to a golf putter and a method for using the same.

Putting is a very important part of the game of golf. On a standard par 72 course, half of the allotted strokes toward par are allocated for putting. There are at least two important aspects in learning to be a good putter, these include proper alignment of the putter blade with respect to the target, and proper alignment of the golfer's eyes with respect to the golf ball. The importance of proper alignment of the putter blade with respect to the target is self evident since the object of putting is to accurately control the trajectory of the golf ball. The importance of eye position is that without ones eyes directly over the golf ball, the golfer cannot properly determine and learn the correct relationship between the putter face and the target. The importance of proper eye position in putting was pointed out by Jack Nicholas in his book, *Golf My Way.*

The traditional putting method employs a square body position and a square putting blade. Using this method, a golfer can easily pick the wrong line over the golf ball. What happens is the golfer picks the correct trajectory when lining up the golf ball with the target when viewing behind the golf ball but picks the wrong trajectory when over the golf ball. Thus, the golfer picks an unintended trajectory when standing over the golf ball and misses a make-able putt.

Moreover, many golfers are unable to make successful putts repeatedly due to inconsistent form or movement. The golfer may move his or her wrists, arms, or shoulders differently from one putt to the next. Another common problem among golfers during putting is that the golfer may bend or "break" his wrists during putting. This can cause loss of directional and speed control of the golf ball during putting, resulting in poor speed and/or direction, and in its most extreme form, a phenomena commonly known as the "yips."

BRIEF SUMMARY OF THE INVENTION

An aspect of the present invention is to provide a method for more accurately putting a golf ball.

Another aspect of the present invention is to provide a method for putting a golf ball which can be practiced by a wide variety of golfers.

Still another aspect of the present invention is to provide a golf putter with improved balance.

The golf putter includes a putter head having a putting face, top, and bottom; a shaft operatively connected to the putter head; and a grip operatively connected to the shaft. Advantageously the putter head is balanced on either side of the shaft. Preferably the shaft is counter balanced; i.e. the weight of the head is counterbalanced so that the balancing point on the shaft is at a mid point of the length of the shaft plus the head.

Generally, the method involves three basic elements: approach, positioning, and putting. The method begins with approach of the golf ball on the green. First, the golfer must approach the golf ball and place the big toe of his or her foot furthest from the target adjacent the golf ball. The position of the golfer in relation to the golf ball is important as the golfer may push or pull the ball if they are too close or too far away from the golf ball.

Next, the golfer assumes a position with his or her dominant eye directly over the golf ball, lining up the golf ball with the target. The golfer stands in a position comfortably upright at forty-five degrees (45°) to the target line. The upper portion of the putter is anchored to the golfer's body using one's target-sided arm. The golfer uses the other arm, which should be the dominant arm, to grasp the putter comfortably.

Finally, to make the putt, the golfer simply allows the dominant hand and arm to move back and forward in good tempo, causing the putter head to move along the target line.

BRIEF DESCRIPTION OF THE DRAWINGS

Reference is now made to the accompanying drawings which illustrate the best known mode for carrying out the invention.

DETAILED DESCRIPTION OF THE INVENTION

The following detailed description provides numerous specific details for a thorough understanding of the invention; however, it will be understood by those skilled in the art that the invention may be practiced without these specific details. In other instances, well-known methods, procedures, and components have not been described in detail so as not to obscure the present description.

Figure 1:
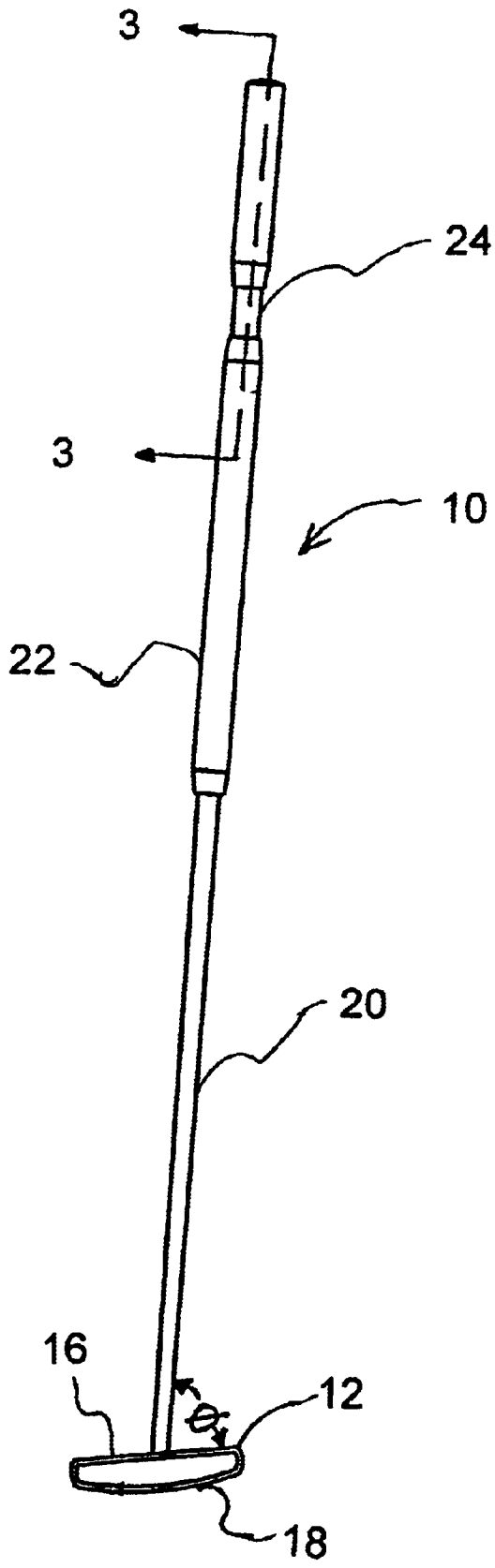
FIG. 1 is a front view of a golf putter in accordance with a preferred embodiment of the present invention.

Referring now to the drawings, and initially to FIG. 1, a golf putter in accordance with a preferred embodiment is generally indicated by numeral 10. The golf putter 10 includes a putter head 12, a shaft 20, and a grip 22. The putter head 12 has a top 16 and a bottom 18. The putter head 12 and the grip 22 are made from materials well-known in the art of golf putter manufacture. The shaft 20 is preferably hollow and made from stainless steel, but other materials may be used. The length of the shaft 20 is advantageously varied according to the height of the golfer, more specifically the height of the waist of the golfer. The shaft 20 is preferably a "long shaft" in the range of 38 to 45 inches (96.5 to 114.3 centimeters). Because the length of the shaft varies, an angle θ between the putter head 12 and the shaft 20 will also vary. Typically angle θ will be between 78 and 84 degrees. As the shaft length decreases, the angle θ becomes more acute and vice versa. This allows the golfer's dominant eye to be directly over the ball and the distal end of the shaft to be at the golfer's waist.

Figure 2:
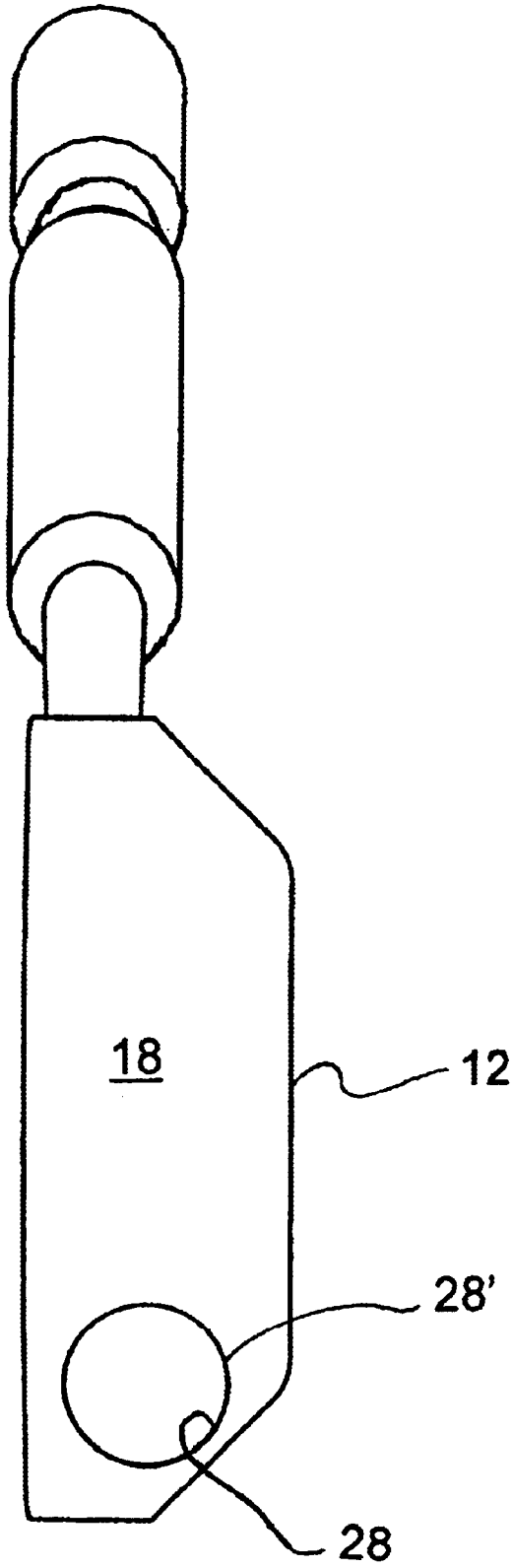
FIG. 2 is a bottom view of the head of the putter shown in FIG. 1.

Referring now to FIG. 2, the putter head 12 is preferably balanced so that the "sweet spot", or center of percussion, is at the center of the head. Because angle θ will vary, the location of the center of percussion will move slightly unless a correction is made. For this purpose head 12 has a cavity 28 to accept a variable balancing insert 28'. In the preferred embodiment, the insert 28' is a polymeric material but other plastics, ceramics, or metallic materials may be used. Preferably, the insert 28' has a different density than the material used in the putter head 12. As indicated, as the angle θ changes, so does the location of the "sweet spot" on the putter head 12. The difference in density allows one to effectively balance the putter head 12 and control the location of the "sweet spot". The bottom 18 of the putter head 12 is advantageously arcuate. In the preferred embodiment, the cavity 28 is located in bottom 18 adjacent the toe of the head 12; however other locations are contemplated. The function served is that of having an easy means for balancing the head to control the location of the "sweet spot". This could also be accomplished by an added balancing weight. Another method of balancing the putter head 12 is simply removing material from the cavity 28.

Figure 3:
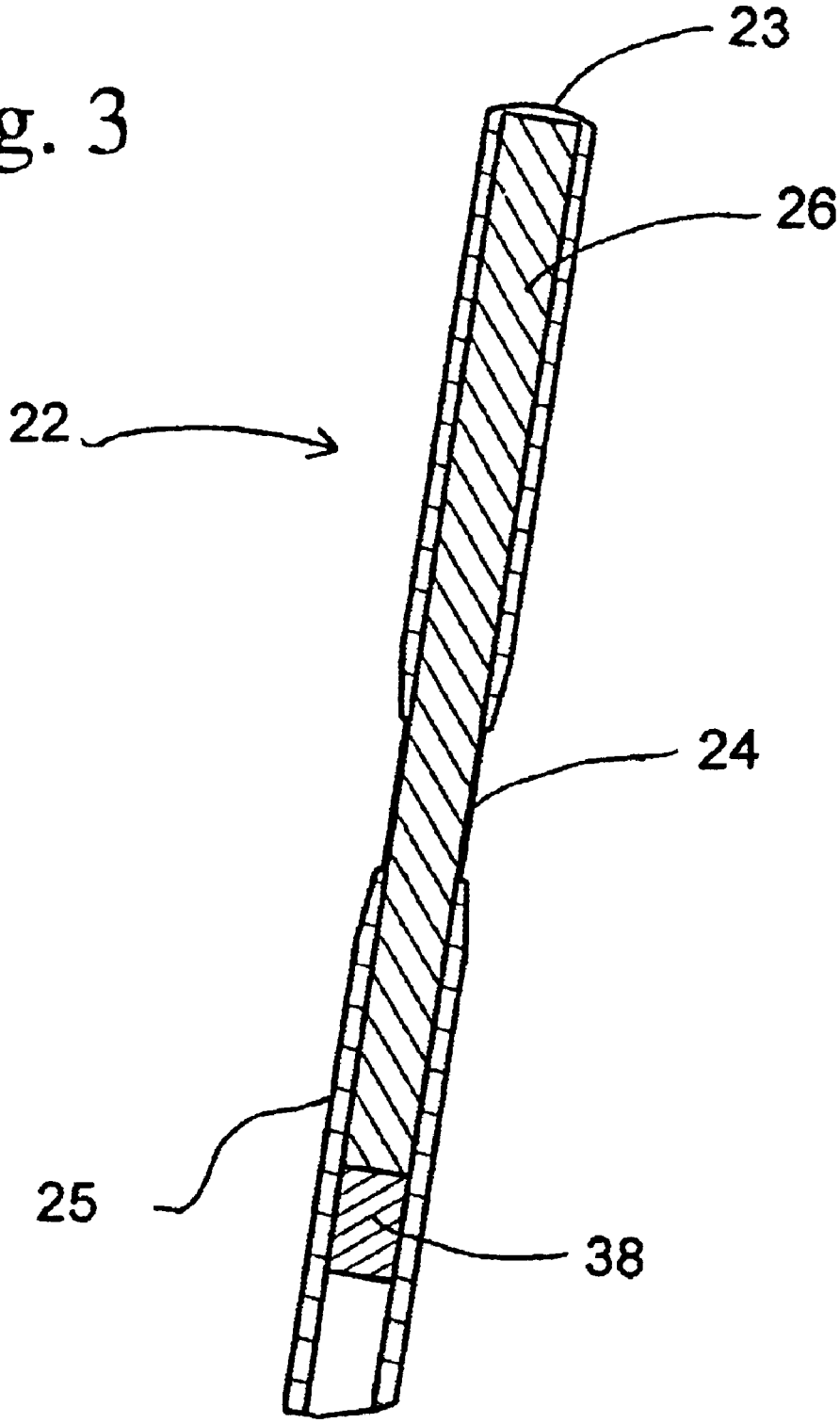
FIG. 3 is a cross-sectional view taken generally along line 3—3 in FIG. 1.

The shaft 20 is preferably counterbalanced; that is, means is provided to counterbalance the head 12 so that a fulcrum at the center of the shaft would be in a balancing position. The phrase "center of the shaft" means the center of the distance from the distal end of the shaft 20 to the bottom 18 of the head 12. Referring now to FIG. 3, inside the shaft 20 is a weight 26 and a stopper 38. The weight 26 is preferably adjustable and, for this purpose can be steel pellets, for example. The weight may also be a solid lead bar. Other materials are contemplated and adjustable weights other than pellet are also contemplated. The stopper 38 is conveniently cork; however other compressible or resilient materials can be used. The function served is to provide a wall or abutment to hold the weight within an area at the distal end of the shaft 20. Because the length of shaft 20 will vary, the location of the "center of the shaft" will vary. Hence, the size of the weight 26 varies accordingly to the length of the shaft 20. The weight 26 acts as counter-balance and allows the golfer to pivot the golf putter 10 more easily or naturally.

Because the height of the golfer will vary, the length of shaft 20 will vary and the location of a grip for the dominant hand will vary. As shown in FIG. 3, grip 22 includes an upper portion 23 and a lower portion 25. These portions are spaced to provide a gap 24. Gap 24 is generally decorative in nature and may not exist in some applications. However, having the grip 22 in two portions 23, 25, allows the location of the lower portion 25 to be adjusted to accommodate a convenient or comfortable position of the dominant hand.

The golf putter 10 is used by a golfer to putt a golf ball on a putting green. Generally, the golfer has a left foot and a right foot, each with a big toe, a dominant hand, a dominant arm, a target-sided hand, a target-sided arm, and a dominant eye. In putting, the golfer ordinarily determines a line or target line for putting the ball into the cup. The preferred method of using the golf putter 10 involves multiple steps. The golfer places the foot furthest from the cup adjacent the ball with the big toe positioned approximately perpendicular to the target line. Some golfers may vary the angle between the big toe and the target line for added comfort. The golfer positions his or her dominant eye directly over the golf ball. The golfer stands in a position comfortably erect or upright with his or her feet at forty-five (45) degrees to the target line. What this means is that an imaginary line connecting the toes of one's golf shoes is forty-five (45) degrees to the target line. The golfer grasps the upper portion 23 of the grip 22 with the hand of the target-sided arm. In a preferred method, the golfer uses that hand to hold the upper portion 23 of the grip 22 at the waist of the golfer's body. The golfer grabs the lower grip portion 25 with the other hand which is usually the hand of his or her dominant arm. Finally, the golfer moves the dominant hand and arm along the target line with sufficient force to drive the golf ball to the cup.

Figure 4:
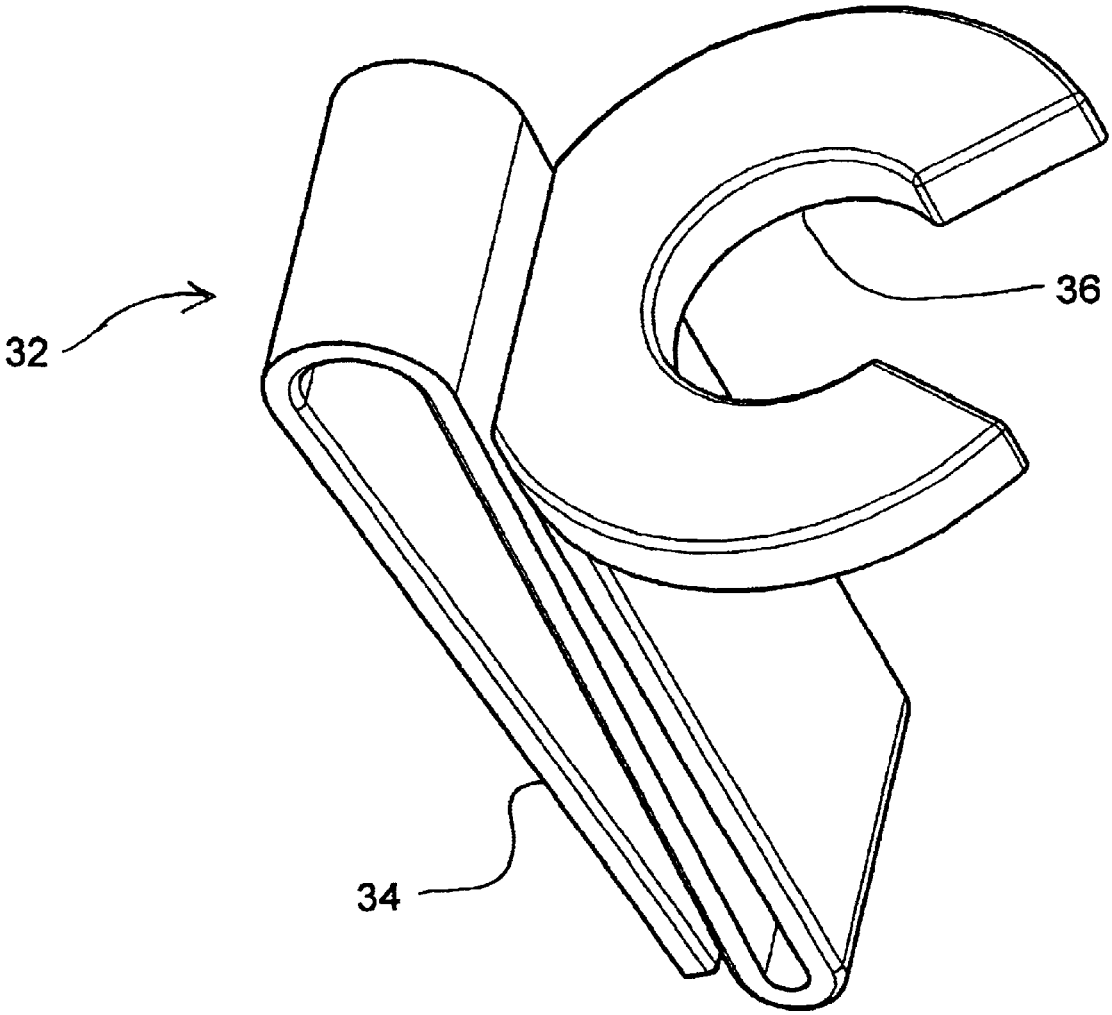
FIG. 4 is an isometric view of a clip usable in practicing the steps of a method embodying the present invention.

The golfer achieves better results after practicing with the golf putter 10. A preferred method of practice utilizes a means for holding the upper portion of grip portion 23 at the waist of the golfer. The holding means may encompass a wide variety of mechanical connections but a preferred embodiment utilizes a clip 32 shown in FIG. 4. The clip 32 has a U-shaped metal band 34 and an outwardly-extending, C-shaped eyelet 36. The band 34 serves a spring function and the golfer can attach the clip 32 to his or her belt or pant's waist using it. The golfer can hold the upper portion 23 at his or her waist by inserting it into the eyelet 36. By practicing with the clip 32, the golfer may gain a sense of how best to pivot the golf putter 10 while maintaining the upper portion 23 of the grip 22 close to his or her body.

Figure 5:
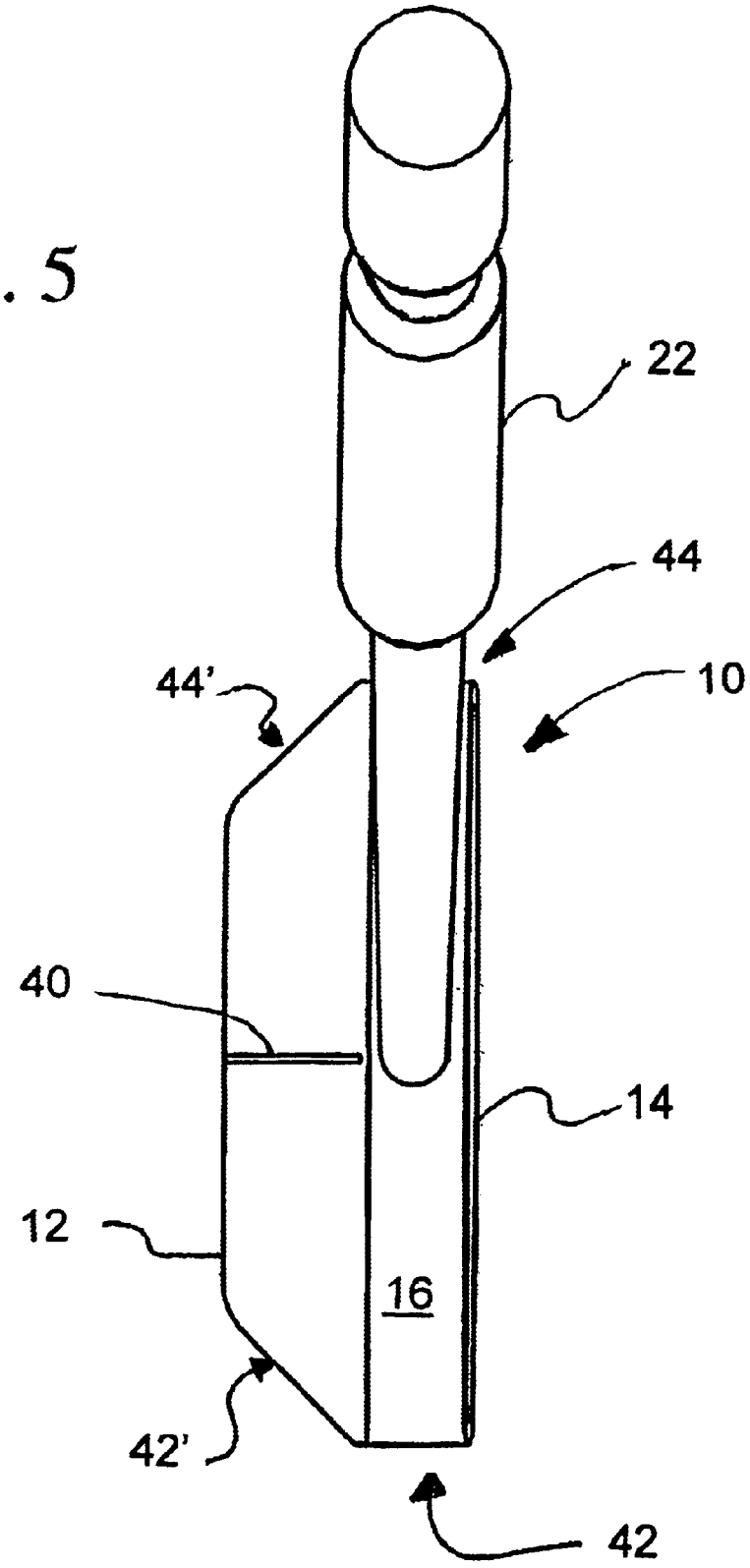
FIG. 5 is a top view of the golf putter shown in FIG. 1

Referring now to FIG. 5, the golf putter 10 shown as viewed from the top. The putter head 12 has a putter face 14. The putter head 12 includes a putter marking 40. The marking 40 provides the golfer with a reference for lining up the putter head 12 with the target line. The putter head 12 includes a toe portion 42 and a heel portion 44. Each portion 42, 44 has an outwardly-facing, rearwardly-extending face 42' or 44'. The rearwardly-extending face 44' of the heel portion 44 helps in practicing the method hereinafter described. As shown in FIG. 5, each rearwardly-extending face 42' or 44' is at an angle of about forty-five degrees to the putter face 14. The putter includes a backside 50 opposite of the putter face 14. As can be seen in FIG. 5, the backside 50 is longer than either the rearwardly-extending face 42' of the rearwardly-extending face 44'.

In summary, the method of putting a golf ball by a golfer having a body, two feet each with a big toe, a dominant eye, a target-sided arm with an accompanying hand, and a dominant arm with an accompanying hand, comprising the steps of: providing a golf putter having a putter head with a putting face, a shaft, and a grip, the grip having an upper portion and a lower portion; determining a target line for putting the golf ball into a cup; approaching the golf ball such that the big toe of the foot furthest from the target is placed adjacent to the golf ball and substantially perpendicular to the target line; positioning the golfer's dominant eye is directly over the golf ball; positioning the golfer's body comfortably erect at forty-five degrees to the target line; gripping the putter comfortably with the golfer's dominant arm; and putting the golf ball by moving the dominant arm and putter along the target line such that the putting face engages the golf ball with appropriate force to drive the golf ball to the cup.

Other aspects, objects and advantages of the present invention can be obtained from a study of the drawings, the disclosure and the accompanying claims. The invention in its broader aspects is not limited to the specific steps and apparatus shown and described but departures may be made therefrom within the scope of the accompanying claims without departing from the principles of the invention and without sacrificing its chief advantages.

What is claimed is:

1. A golf putter comprising:

a putter head having a putting face, a top, a bottom, a toe portion, and a heel portion, the toe and heel portions having an outwardly-facing, rearwardly-extending face at an angle of about forty-five degrees to the putting face;

a counterbalanced shaft having a proximate end and a distal end, the shaft operatively connected at its proximate end to the putter head;

a grip at the distal end of the shaft; and a clip for operatively connecting to the upper portion of the grip, the clip having a U-shaped band and a C-shaped eyelet for lying circumjacent the grip.

2. The golf putter according to claim 1, wherein said clip for operatively connecting to the upper portion of the grip is adapted to engage a waist band of a golfer and provides a pivoting point for said counterbalance shaft.

3. The golf putter according to claim 1, in which the grip includes an upper portion and a lower portion spaced from the upper portion to provide a gap therebetween.

4. The golf putter according to claim 1, in which the bottom of the putter head is arcuate.

5. The golf putter according to claim 1, in which the putter head further includes a marking for aligning the putter head with the target line.

6. The golf putter according to claim 1, in which the length of the shaft is from about 96 centimeters to about 114 centimeters.

7. The golf putter according to claim 1, further comprising:

a cavity located substantially in the bottom of the putter head; and a balancing insert operatively attached to the cavity, whereby adjusting the location of the cavity and the accompanying balancing insert controls a location of a center of percussion on the putter head face.

8. The golf putter according to claim 7, in which the balancing insert is a polymeric material.

9. The golf putter according to claim 7, in which the balancing insert and the putter head each have a density, wherein the density of the balancing insert is less than the density of the putter head.

10. The golf putter according to claim 1, wherein the counterbalanced shaft includes a weight located within an upper portion of the shaft.

11. The golf putter according to claim 10, in which the counterbalanced shaft includes a stopper in the shaft to position the weight.

12. The golf putter according to claim 10, in which the weight is in pellet form.

13. The golf putter according to claim 10, in which the weight is one-piece.

14. The golf putter according to claim 1, wherein said clip for operatively connecting to the upper portion of the grip is adapted to engage a belt of a golfer and provides a pivoting point for said counterbalanced shaft.

* * * * *